US007293372B2

(12) United States Patent
Nakano

(10) Patent No.: US 7,293,372 B2
(45) Date of Patent: Nov. 13, 2007

(54) FOOTWEAR UPPER WITH FLEXIBLE COLLAR ASSEMBLY

(75) Inventor: Kiyotaka Nakano, Rockford, MI (US)

(73) Assignee: Wolverine World Wide, Inc., Rockford, MI (US)

( * ) Notice: Subject to any disclaimer, the term of this patent is extended or adjusted under 35 U.S.C. 154(b) by 296 days.

(21) Appl. No.: 10/961,898

(22) Filed: Oct. 8, 2004

(65) Prior Publication Data

US 2006/0075663 A1 Apr. 13, 2006

(51) Int. Cl.
*A43B 5/00* (2006.01)
*A43B 1/10* (2006.01)

(52) U.S. Cl. ..... 36/45; 36/102; 36/118.2

(58) Field of Classification Search ..... 36/102, 36/45, 118.2, 115
See application file for complete search history.

(56) References Cited

U.S. PATENT DOCUMENTS 1,610,700 A * 12/1926 Dudley ..... 36/89
3,419,974 A * 1/1969 Lange ..... 36/117.6
3,535,800 A * 10/1970 Stohr ..... 36/118.2
3,844,055 A * 10/1974 Koyama et al. ..... 36/118.2
3,988,842 A * 11/1976 Rathmell ..... 36/117.9
4,509,276 A 4/1985 Bourque
4,602,443 A 7/1986 Spademan
4,615,128 A 10/1986 Borsoi
4,655,465 A 4/1987 Schaeffer
4,665,635 A 5/1987 Benoit et al.
4,905,385 A 3/1990 Perrissoud
5,216,826 A 6/1993 Chaigne et al.
5,329,707 A 7/1994 Chaigne et al.
5,341,584 A 8/1994 Paris et al.
5,342,070 A 8/1994 Miller et al.
5,446,976 A 9/1995 Donnadieu et al.
5,498,033 A 3/1996 Hoshizaki et al.
5,636,455 A 6/1997 Meiselman
5,640,787 A 6/1997 Spademan
5,678,331 A 10/1997 Bonaventure
5,752,331 A 5/1998 Perrissoud et al.
5,806,212 A 9/1998 Benoit et al.
5,833,639 A 11/1998 Nunes et al.
D402,327 S 12/1998 Aired et al.
5,909,885 A 6/1999 Borel
5,924,706 A 7/1999 Seltzer et al.
5,926,979 A 7/1999 Borel
6,006,452 A 12/1999 Bonaventure
6,009,639 A 1/2000 Donnadieu et al.
6,094,842 A 8/2000 Borel
6,131,313 A 10/2000 Pierce et al.
6,381,877 B2 5/2002 Filice
6,453,580 B1 9/2002 Lancon
6,539,648 B1 4/2003 Collavo
2002/0088146 A1 7/2002 Joseph et al.

FOREIGN PATENT DOCUMENTS

EP 556799 A1 * 8/1993

* cited by examiner

*Primary Examiner*—Marie Patterson
(74) *Attorney, Agent, or Firm*—Warner Norcross & Judd LLP

(57) ABSTRACT

A footwear upper having a collar assembly that is joined at its forward edge to the lower portion of the upper by a flexible region of material so that the collar may flex forward and rearward in relation to the lower portion of the upper. In one aspect of the invention, the upper includes a neck portion that is telescopically overlapped by the collar. In another aspect, the upper includes a gusset that extends between the lower portion and the collar, with at least a portion of the gusset being substantially hidden from view.

9 Claims, 7 Drawing Sheets

FOOTWEAR UPPER WITH FLEXIBLE COLLAR ASSEMBLY

BACKGROUND OF THE INVENTION

The present invention relates to footwear, and more particularly to a flexible collar assembly for an article of footwear.

A wide variety of articles of footwear include a collar assembly that functions to provide support to the ankle region. The function of support is generally accomplished by providing a rigid or relatively stiff material in the collar region that presents resistance to movement of the upper in the ankle region. The collar helps to reduce the risk of supranation, pronation, and hyperextension. However, conventional collars suffer in that they limit the range of motion of the ankle and otherwise lead to discomfort in that area.

Many conventional upper constructions are formed from a continuous piece of material that wraps around the ankle region. This typical construction provides support to the ankle region, but compromises the range of motion of the footwear in both the forward/rearward and medial/lateral directions. When the ankle flexes forward or rearward during walking, the collar assembly impedes the natural motion of the ankle and therefore may result in discomfort. Furthermore, the relatively inflexible collar assembly may cause unnecessary rubbing in the Achilles region which may lead to discomfort or soft tissue injuries in that region.

Some efforts toward a more flexible footwear upper have been made in the area of ski boots and skate boots. Due to the nature of these activities, and the extra support they require, ski and skate boots are typically comprised primarily of very rigid materials, such as injection molded plastic. In an effort to provide some flexibility in a forward/rearward direction, some of these ski and skate boots include cutouts in the rigid material in the front and/or rear of the ankle region. The cutouts provide flexion only in the forward/rearward direction so the boot is essentially rigid in the medial/lateral direction. The cutouts may be closed with a flexible insert attached to the exterior of the upper that allows the cutout to open and close with the flexion of the ankle. These inserts protect the ankle in the areas of the cutouts, but they are often bulky and unsightly.

The above noted efforts provide at least some degree of flexibility in the forward/rearward direction, however, they are tailored for use with the rigid materials of ski and skate boots and do not provide sufficient flexibility for many other applications. Furthermore, the components used to provide flexibility to the collar are exposed and visible, and therefore affect the overall aesthetics of the footwear.

SUMMARY OF THE INVENTION

The aforementioned problems are overcome by the present invention wherein an article of footwear includes a footwear upper having a lower portion and a collar assembly joined directly to the lower portion. The collar may be a separate component that is attached to the lower portion or it may be a continuous extension of the lower portion. In one aspect of the invention, the upper also includes a gusset joining the collar to the lower portion along the edge portions not directly joined to the lower portion. At least a portion of the gusset is hidden from view by the collar or the lower portion.

In another aspect, the upper further includes a neck portion that extends upwardly from the remainder of the lower portion and wraps around the Achilles region. The collar is telescopically fitted over the neck creating an overlapping region so that the collar slides over the neck during flexion of the footwear. The neck may be a flexible material, such as padded fabric, that is secured to a lower portion or may be a continuous extension of the lower portion. In one embodiment, a gusset extends between and interconnects the neck and the collar.

The present invention provides a relatively high degree of support in the lateral/medial direction while at the same time providing a range of relatively free movement in the forward/rearward direction. The present invention allows movement of the collar in relation to the lower portion, resulting in improved range of motion and decreased forces exerted on the lower leg during flexion of the upper forward or rearward. In those embodiments that include a neck, the neck lays against the Achilles region of the wearers foot protecting it from rubbing that might otherwise be caused by movement of the collar. The neck also provides comfort and support to the ankle region. Further, in those embodiments that include a gusset, the gusset prevents foreign material from entering the boot and may be hidden within the collar providing the aesthetic appearance of conventional looking footwear.

These and other objects, advantages, and features of the invention will be more readily understood and appreciated by reference to the detailed description of the current embodiments and the drawings.

DETAILED DESCRIPTION OF THE CURRENT EMBODIMENTS

Figures 1, 2, 3:
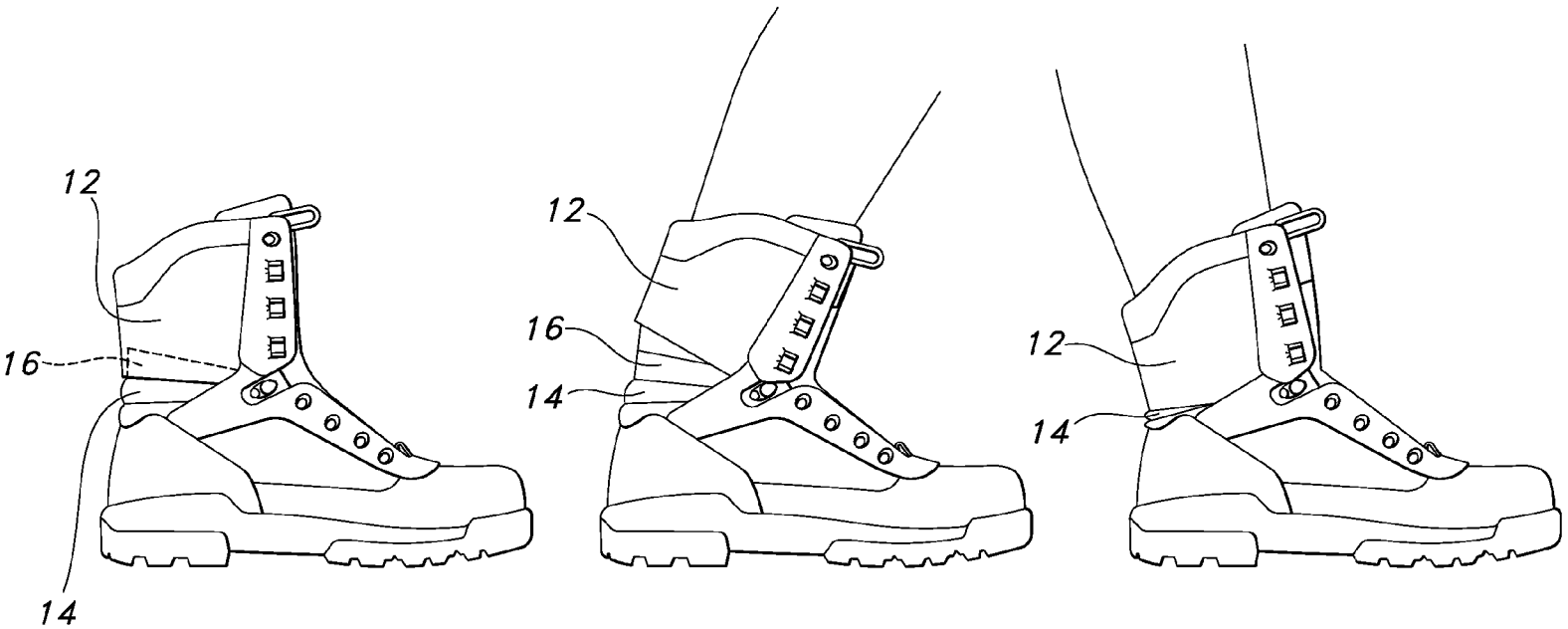
FIG. 1 is a side view of an article of footwear incorporating the present invention.
FIG. 2 is a side view of an article of footwear incorporating the present invention flexed forward.
FIG. 3 is a side view of an article of footwear incorporating the present invention flexed rearward.
Figure 4:
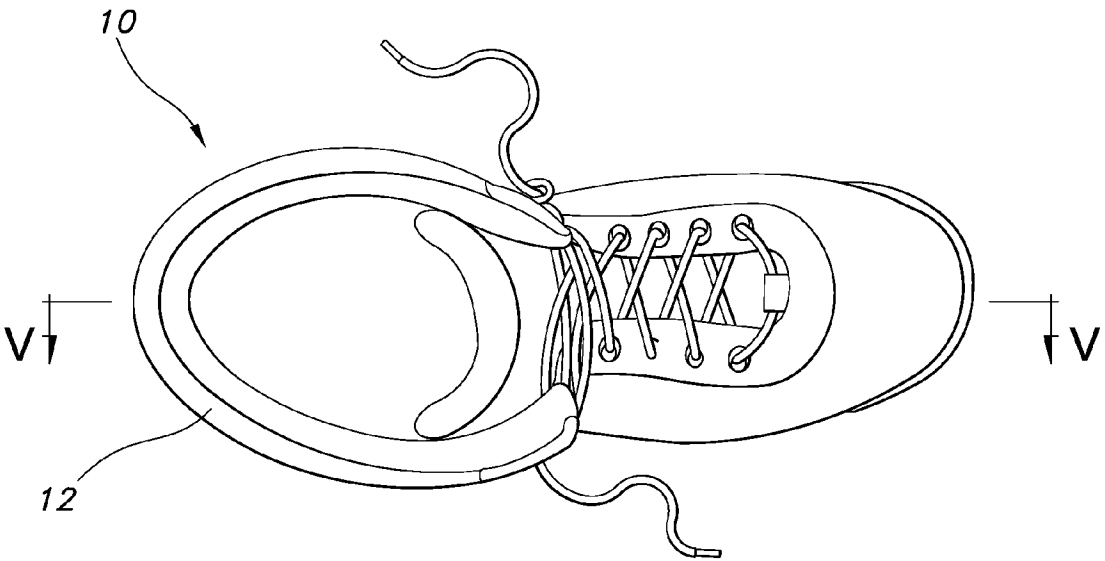
FIG. 4 is a top view of the article of footwear.
Figure 5:
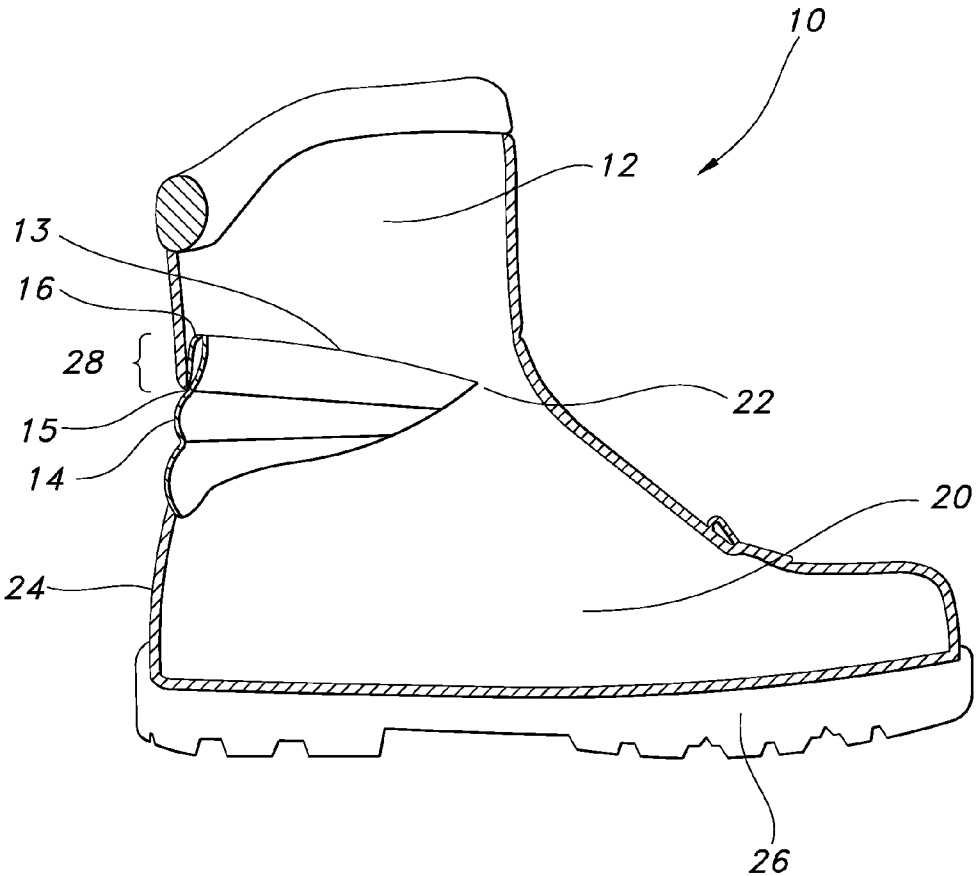
FIG. 5 is a sectional view along line V-V in FIG. 4.
Figure 6:
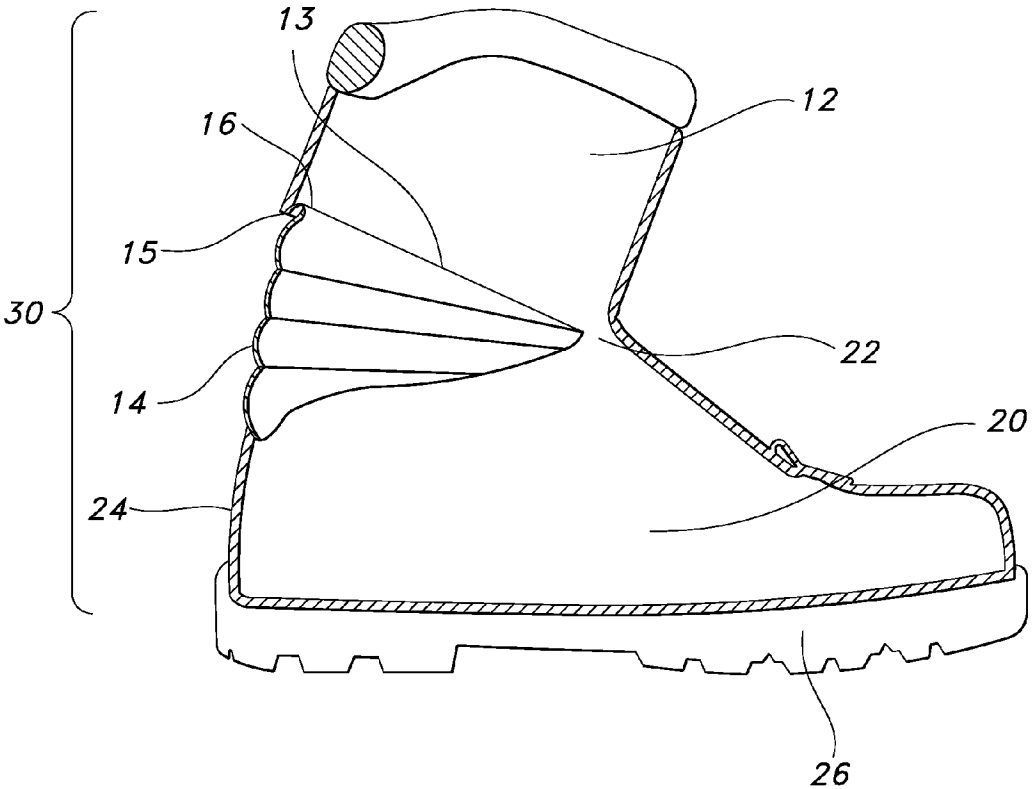
FIG. 6 is a sectional view similar to that along line V-V in FIG. 4, when the article of footwear is flexed forward.
Figure 7:
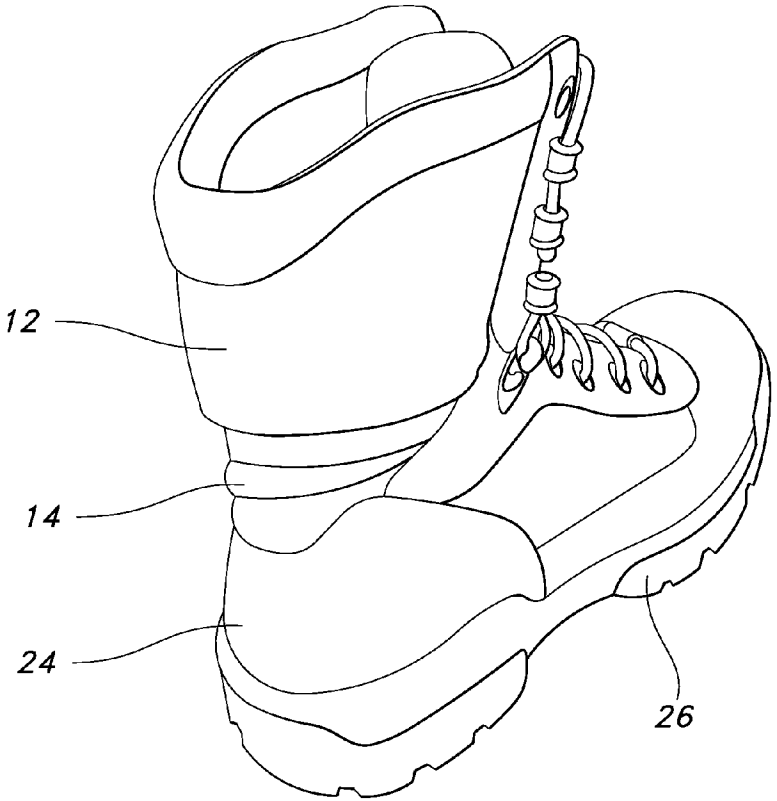
FIG. 7 is a perspective view of an article of footwear incorporating the present invention.

An article of footwear having a footwear upper with a collar assembly according to a preferred embodiment of the present invention is illustrated in FIG. 1, and generally designated 10. For purposes of this disclosure, an upper assembly 30 will be described in connection with a conventional mid-height boot; however, the invention is equally well-suited for use in other types of footwear that may incorporate a collar 12, such as full-height boots and high-top athletic shoes. In the illustrated embodiment, the footwear upper assembly 30 generally includes the collar 12 flexibly joined only at its forward edge to a lower portion 20 of the upper 30 creating a flexible region of material 22 so that the collar 12 may flex forward and rearward in relation to the lower portion 20 of the upper 30. In this embodiment, the upper 30 further includes a neck portion 14 that extends upwardly from the remainder of the lower portion 20 and wraps around an Achilles region. The illustrated upper also includes a gusset 16 joined between the neck 14 and the collar 12.

The components of the assembly may be constructed from one continuous piece of material or joined by other conventional ways such as stitching, adhering, stapling, or cementing. Furthermore, as used herein, terms such as "forward," "rearward," "top," and "bottom" will be used with respect to the direction viewed by a user wearing the footwear. Such terms are used merely for convenience of reference, and not intended to be taken as limiting in any regard.

The boot 10, shown in FIGS. 1-7, generally includes the upper assembly 30 and a sole assembly 26. The upper assembly 30 is manufactured from conventional materials, for example, leather, fabric or other sufficiently durable and flexible material. The style of the upper assembly 30 and the manner of securing it to the sole assembly 26 will vary depending on the design of the footwear. The upper assembly 30 may include multiple layers. For example, the upper may include a conventional lining material, padding layer, an insulating layers, a waterproof layer or other conventional materials. The boot 10 may include essentially any type of sole assembly 26. For example, the sole assembly 26 may includes a conventional cement, welt, direct attach, Opanka, stroble or other sole construction. Accordingly, the sole assembly 26 will not be described in detail herein.

In the illustrated embodiment, the upper assembly 30 includes the collar 12 and the lower portion 20. The lower portion 20 generally includes one or more sections of material that are configured to define a space adapted to receive the wearer's foot. The lower portion 20 of the illustrated embodiment extends from the toe region through the heel regions and defines an ankle opening. In this way, the lower portion 20 forms an essentially closed space for the wearer's foot. The lower portion 20 is not necessarily closed, however, and may include open regions for ventilation or other purposes. The boot 10 of the illustrated embodiment includes a relatively conventional lacing system for selectively securing the boot 10 on the wearer's foot. As shown, the lower portion 20 of this embodiment includes a plurality of conventional lacing loops or eyelets that permit the lower portion 20 to be selectively snuggly secured over the wearer's foot. The boot 10 may alternatively include other closure systems, such as snaps, buckles, Velcro® fasteners or other lacing systems. The collar 12 generally includes one or more sections of material configured to wrap around the wearer's leg roughly at or above the ankle region. The collar 12 includes a forward edge that is joined to the lower portion 20 creating the flexible region of material 22 so that the collar 12 may flex forward and rearward in relation to the lower portion 20. In one embodiment, the collar 12 is joined by stitching to the lower portion 20; however, the collar 12 may also be a continuous extension of the lower portion 20. Furthermore, the collar 12 may be an extension from a lacing system that attaches to the lower portion 20, or attach to the lower portion by another conventional manner. The collar 12 of the illustrated embodiment supports a plurality of lacing loops that permit the collar to be selectively drawn snuggly around the wearer's leg. As with the other portions of the upper 30, the collar 12 may by padded and include other conventional lining materials as desired.

In the illustrated embodiment, the upper 30 further includes a neck 14 portion that extends upwardly from the remainder of the lower portion 20 wrapping around the ankle and/or Achilles region. The precise height of the neck 14 may vary from application to application. In fact, the neck 14 may be eliminated in some applications. The neck 14 generally includes a flexible padded material that provides cushion and support to the ankle area, but may be any of a variety of other conventional materials. In the illustrated embodiment, the neck 14 is a separate component that is secured to the lower portion 20 by stitching. Although the neck 14 of the illustrated embodiment is stitched to the lower portion 20, it may equally be a continuous extension of the lower portion 20 or joined to the lower portion 20 by another conventional manner. In the embodiment shown in the figures, the collar 12 surrounds at least the upper portion of the neck 14 forming an overlapping telescopic region 28. In this embodiment, the flexible region of material 22 allows the collar 12 to flex forward or rearward in relation to the neck 14 causes the collar 12 to move over the neck 14 in a sliding telescopic manner.

The upper assembly 30 of the illustrated embodiment further includes a gusset 16 connected to the neck 14 and collar 12. As noted above, the collar 12 is flexibly movable in the forward/rearward direction between a rearward position, a central (unflexed) position and a forward position. In one specific embodiment, the gusset 16 is a flexible material having one edge connected to the top 15 of the neck 14 and another edge connected to the bottom 13 of the collar 12. The gusset 16 includes sufficient slack to permit the collar 12 to flex freely forwardly and rearwardly through the desired range of motion. The size of the gusset 16 may be selected to provide a limit on the amount of forward and rearward movement of the collar 12. For example, the collar may include only one inch of slack to limit forward and rearward movement of the collar 12 to only one inch. In the illustrated embodiment, the gusset 16 is hidden behind the collar 12 providing the aesthetic appearance of a conventional looking boot. The collar 12, neck 14 and gusset 16 may be configured so that the gusset 16 is hidden only in one or more of these collar positions or so that the gusset 16 is exposed regardless of the position of the collar 12. For example, the collar 16 may be extended beyond the overlapping region 28 down over the ankle region. The gusset 16 may have a variety of folds, such as a single fold or several folds in an accordion fashion. As an alternative to providing the gusset with slack, the gusset may be manufactured from an elastic material that stretches when the collar 12 flexes in the forward/rearward direction. In this alternative embodiment, the size, shape and elasticity of the gusset may be selected to provide limits on the forward/rearward range of motion of the collar.

The operation of the invention provides a range of relatively free forward and rearward flexibility about the ankle region, while still providing substantial ankle support. In an embodiment that includes the gusset 16, as the collar 12 flexes forward about the flexible region of material 22, the rearward part of the collar 12 slides upwardly over the neck 14 decreasing the extent of the overlapping region 28. Simultaneously, the gusset 16 is pulled upwardly with the collar 12. As the collar 12 flexes rearward about the flexible region of material 22, the rearward part of the collar 12 slides downwardly over the neck 14, which increases the extent of the overlapping region 28 and pulls the gusset 16 downward. As the collar 12 moves forwardly and rearwardly, the gusset 16 keeps debris from entering the boot through the space between collar 12 and the neck 14. As shown, the gusset 16 is hidden underneath the collar 12 when the collar 12 is in a central (unflexed) position. As the collar 12 moves, it slides along the neck 14 and does not directly ride along the upper heel or Achilles region of the wearer's foot. Accordingly, the neck 14 protects the wearer from discomfort.

ALTERNATIVE EMBODIMENTS

Figures 8, 9:
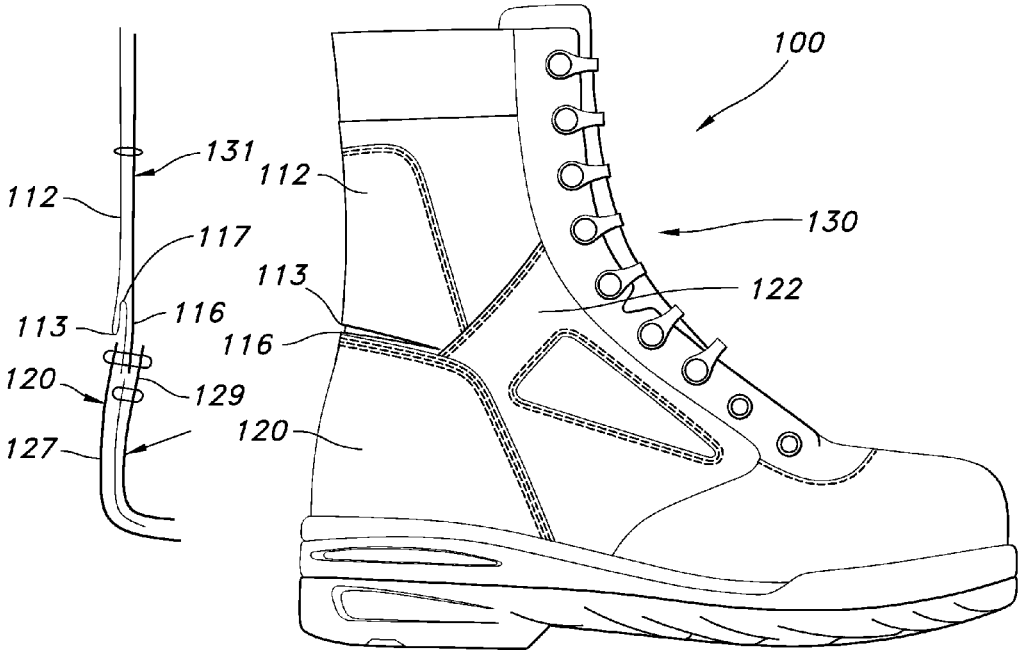
FIG. 8 is a side view of an article of footwear incorporating a first alternative embodiment of the present invention.
FIG. 9 is a cross sectional view of the FIG. 8 embodiment.

A first alternative embodiment is shown in FIGS. 8 and 9. In this embodiment, the article of footwear 100 includes an upper assembly 130 including a collar 112 and a lower portion 120 of the upper 130. Similar to the previous embodiment, a forward edge of the collar 112 may be flexibly joined to the lower portion 120, creating a flexible region of material 122. As shown in FIG. 8, the flexible region 122 may be wider than that shown in the previous embodiment, such that it includes the lacing trim of the boot 100 as well as additional material for joining the collar 112 and lower portion 120. The width of this flexible region 122 may be altered to a variety of sizes, depending on the desired amount of flexibility in the flexible region 122. Like the previous embodiment, the collar 112 may be joined to the lower portion 120 by sewing the collar 112 to the lower portion, or the collar 112 may be an extension of the lower portion 120. As shown in FIG. 9, the upper assembly 130 further includes a gusset 116 and a liner material 131 extending behind the gusset 116. The gusset 116 may be a flexible material with one edge that extends from a bottom edge 113 of the collar 112. A lower edge of the gusset 116 may attach to the lower portion 120, for instance, by stitching the lower edge between an outer layer 127 and an inner layer 129 of the lower portion 120. The liner 131 is manufactured from a stretchable material, such as Lycra, and may be attached between the collar 112 and the lower portion 120, such as by stitching an upper portion of the liner 131 to the collar 112 and a lower portion of the liner between the inner 129 and outer 127 layers of the lower portion 120. As shown, the gusset 116 includes a region of slack that is provided with a fold 117 by stitching an intermediate portion of the gusset 116 to the liner 131. The gusset 116 may be attached to the liner 131 so that the fold 117 is hidden behind the collar 112. The liner 131 may be positioned on the inside of the boot 100 to prevent gusset 116 from rubbing against the Achilles region of the wearer of the boot.

Figures 10, 11:
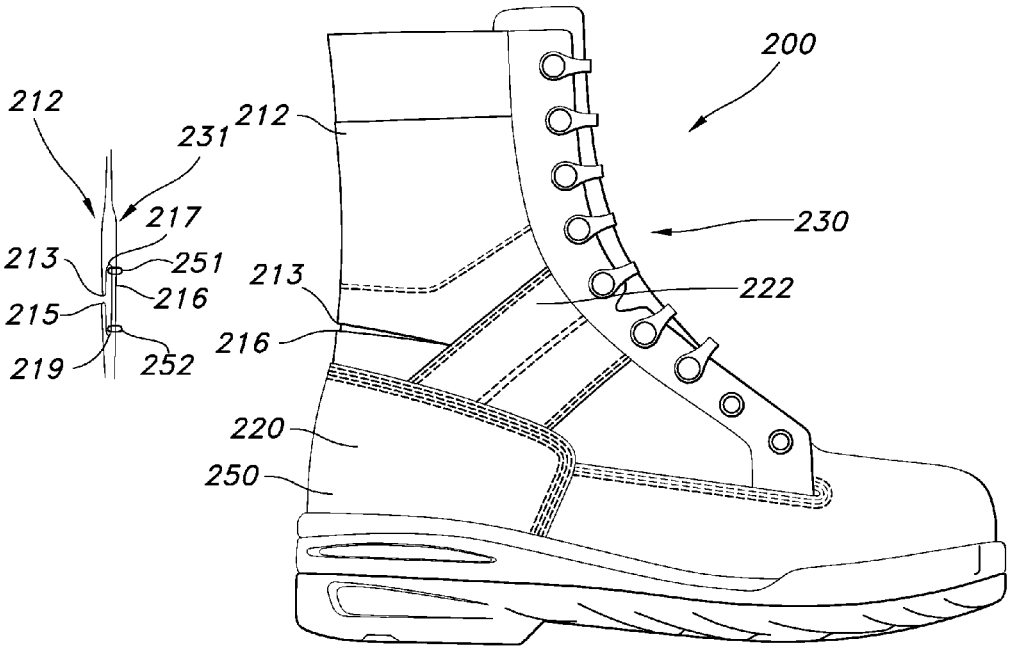
FIG. 10 is a side view of the article of footwear incorporating a second alternative embodiment of the present invention.
FIG. 11 is a cross sectional view of the FIG. 10 embodiment.

A second alternative embodiment is shown in FIGS. 10 and 11. This embodiment is similar to the first alternative embodiment, wherein the upper assembly 230 includes a collar 212 and a lower portion 220. The collar 212 includes a forward edge that is flexibly joined to the lower portion 220 by a flexible region of material 222 similar to the joining of the collar 112 and lower portion 120 of the first alternative embodiment. In this embodiment, the lower portion 220 includes a heel support 250 and an ankle support 260. The ankle support 260 extends upwardly from the heel support 250 in the ankle and/or Achilles region. The ankle support 260 may be stitched to the heel support 250, and as shown may be comprised of a material similar to the collar 212 material. Alternatively, the ankle support 260 may be a continuous extension of the heel support 250. The gusset 216 extends between the bottom edge 213 of the collar 212 and the top edge 215 of the ankle support 260. The gusset 216 may be a flexible extension of the collar 212 and ankle support 260, or it may be a separate material that is stitched to the collar 212 or ankle support 260. As in the first alternative embodiment, a stretchable liner 231 may be attached between the collar 212 and the lower portion 220, such as between the collar 212 and the ankle support 260. As shown in FIG. 11, the gusset 216 may be provided with a first fold 217 extending behind the collar 212 by stitching a portion 251 of the gusset 216 to the liner 231 behind the collar 212, and a second fold 219 extending behind the ankle support 260 by stitching another portion 252 to the liner 231 behind the ankle support 260.

Both of the alternative embodiments operate similar to the first disclosed embodiment, in that they provide a range of relatively free forward and rearward flexibility about the ankle region, while still providing substantial ankle support. In the first alternative embodiment, as the collar 112 flexes forward about the flexible region of material 122 the rearward part of the collar 112 moves upwardly, pulling the gusset 116 upwardly with the collar 112 and unfolding the fold 117. As the collar 112 moves forwardly and rearwardly, the gusset 116 keeps debris from entering the boot through the space between collar 112 and the lower portion 120. In the second alternative embodiment, as the collar 212 flexes forward, about the flexible region of material 222 the rearward part of the collar 212 moves upwardly, pulling the gusset 216 upwardly and unfolding the fold 217. The lower portion 120 may further move downwardly to pull and gusset 216 down and unfold the fold 219. The gusset 216 prevents debris from entering the boot 200. As shown, the folds 117, 217, 219 of the gusset 116, 216 are hidden underneath the collar 112, 212 and the ankle support 260 when the collar 112, 212 is in a central (unflexed) position. The liner 131, 231 may be provided in each embodiment so that as the collar 112, 212 moves it does not directly ride along the upper heel or Achilles region of the wearer's foot. As the ankle flexes forward or rearward and the gusset 216 is pulled upward, the liner 231 stretches behind the gusset 216 to accommodate for the movement of the collar 212 and gusset 216.

The above descriptions are those of current embodiments of the invention. Various alterations and changes can be made without departing from the spirit and broader aspects of the invention as defined in the claims, which are to be interpreted in accordance with the principles of patent law, including the doctrine of equivalents. Any reference to an item in the disclosure or to an element in the claim in the singular using the articles "a," "an," "the," or "said" is not to be construed as limiting the item or element to the singular unless expressly so stated.

The invention claimed is:

1. A footwear upper comprising:

a lower portion defining a foot containing space;

a collar including a forward edge and a bottom edge, a portion of said collar including said forward edge being flexibly joined to said lower portion with a flexible region of material so that said collar may flex forward and rearward in relation to said lower portion; and a gusset attached between said lower portion and said collar along a portion of said bottom edge not directly joined to said lower portion, said gusset including a fold that extends behind said collar or said lower portion.

2. The footwear upper of claim 1 wherein said gusset includes a first fold extending behind said collar and a second fold extending behind said lower portion.

3. The footwear upper of claim 1 further including a liner material attached between said collar and said lower portion.

4. The footwear upper of claim 3 wherein a portion of said gusset is attached to said liner.

5. The footwear upper of claim 3 wherein said liner is a stretch material.

6. The footwear upper of claim 1 wherein said collar and said lower portion are constructed from a continuous piece of material.

7. The footwear upper of claim 1 where said gusset is a continuous extension of said collar.

8. The footwear upper of claim 1 wherein said lower portion includes a heel support and an ankle support, said gusset including a first fold extending behind said collar and a second fold extending behind said ankle support.

9. The footwear upper of claim 7 wherein said gusset is a continuous extension of said collar and said ankle support.

* * * * *